US008580345B2

(12) United States Patent
Van't Hof

(10) Patent No.: US 8,580,345 B2
(45) **Date of Patent: *Nov. 12, 2013**

(54) METHOD OF PROTECTING A FIXTURE

(71) Applicant: Erik Victor Van't Hof, Manhattan Beach, CA (US)

(72) Inventor: Erik Victor Van't Hof, Manhattan Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/648,880

(22) Filed: Oct. 10, 2012

(65) Prior Publication Data

US 2013/0031866 A1 Feb. 7, 2013

Related U.S. Application Data

(63) Continuation of application No. 12/169,579, filed on Jul. 8, 2008, now Pat. No. 8,287,960.

(51) Int. Cl.
*B05D 1/32* (2006.01)

(52) U.S. Cl.
USPC ..... 427/282; 427/256

(58) Field of Classification Search
USPC ..... 427/256, 282
See application file for complete search history.

(56) References Cited

U.S. PATENT DOCUMENTS

| | | | | |
|---|---|---|---|---|
| 2,721,597 | A | 10/1955 | Pitrella | |
| 4,142,565 | A | 3/1979 | Plunkett, Sr. | |
| 4,691,409 | A | 9/1987 | Torgerson et al. | |
| 4,921,028 | A * | 5/1990 | Schwartz | 150/155 |
| 5,008,551 | A | 4/1991 | Randolph | |
| 5,840,122 | A * | 11/1998 | Williams | 118/505 |
| H2137 | H | 1/2006 | George et al. | |
| 7,077,909 | B1 * | 7/2006 | Crane | 118/500 |

OTHER PUBLICATIONS

Erik Van't Hof, Non-final Office Action mailed Jun. 24, 2011 for U.S. Appl. No. 12/169,579.
Erik Van't Hof, Final Office Action mailed Dec. 23, 2011 for U.S. Appl. No. 12/169,579.

* cited by examiner

*Primary Examiner* — Frederick Parker
(74) *Attorney, Agent, or Firm* — Blakely Sokoloff Taylor & Zafman LLP

(57) ABSTRACT

A method including placing a body defining an undifferentiated lumen therein over a portion of a fixture coupled to a building structure, the body having at least one opening that can be expanded from a contracted state and that is biased toward the contracted state, the placing including applying an expansion force to the opening; conforming the body to a shape of the fixture at a contact portion where the fixture contacts the structure by releasing the expansion force; and treating the structure.

15 Claims, 4 Drawing Sheets

METHOD OF PROTECTING A FIXTURE

CROSS-REFERENCE TO RELATED APPLICATION

The application is a continuation of co-pending U.S. patent application Ser. No. 12/169,579, filed Jul. 8, 2008 and incorporated herein by reference.

BACKGROUND

When an area of a structure has one or more fixtures attached to a surface, and that area is being prepared for treatment or is adjacent a structure or fixture to receive treatment, the fixtures must be removed or protected from dust particles or coating material (e.g., paint, stain, etc.) getting into or onto the fixtures. Examples of structures include walls, doors and ceilings of a building, such as a residence or office, or body panels of automobiles or vessels. Examples of fixtures include handles (e.g., door handles), electrical outlets, lighting, smoke detectors, and emblems. Examples of treatments include sanding, painting, staining, stuccoing, and plastering.

Removing a fixture from a structure so that a treatment does not get into or onto the fixture is time consuming. Also, during the removal and subsequent reinstallation process the entire fixture or portions of the fixture may become damaged or may be lost. Similarly, some fixtures are unable to be completely removed. Additionally, some fixtures such as smoke detectors are sensitive and may be inadvertently activated during removal or reinstallation and therefore may cause additional problems. Additionally, many fixtures when removed become inoperable which may cause safety or other problems and/or additional costs.

Generally, protecting a fixture involves covering it. The variety of shapes and sizes of fixtures presents problems during the covering process. One common covering technique utilizes tape, such as conventional duct tape or painter's tape (blue tape), to cover a fixture. However, such tape can cause damage to the fixture upon removal of tape. Similarly, such tape often cannot be tightly molded to the shape of the fixture which can present an inadequate seal of the fixture allowing a coating material to seep between the tape, the fixture and the fixture's attachment surface creating a bond whereby upon tape removal the rigid weak quality of the tape sticks and may leave remaining remnants of the tape upon removal, or damage the painted surface. Consequently, the fixture may need to be cleaned, replaced and/or the job must be redone. Still tape may not adequately cover larger fixtures thereby requiring other material such as paper or plastic bags to be additionally attached.

Another technique covers fixtures in a project area using a wide variety of covering material with an aim toward preventing such particles or coating material from entering into or onto fixtures. Known covering techniques have generally not proven satisfactory. For example, such material is often of a make shift nature, which does not lend itself to effectively and reliable covering fixtures. Many of these types of materials are remnants of used materials on the job site. Covering material such as paper, plastic bags or plastic sheets may not be of appropriate size resulting in an inadequate seal or in physical maneuvering during application of coating material. Moreover, such material can damage fixtures upon installation or removal. Similarly, this process can be time consuming and one must have two materials, bag or paper and adhesive material.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Figure 1:
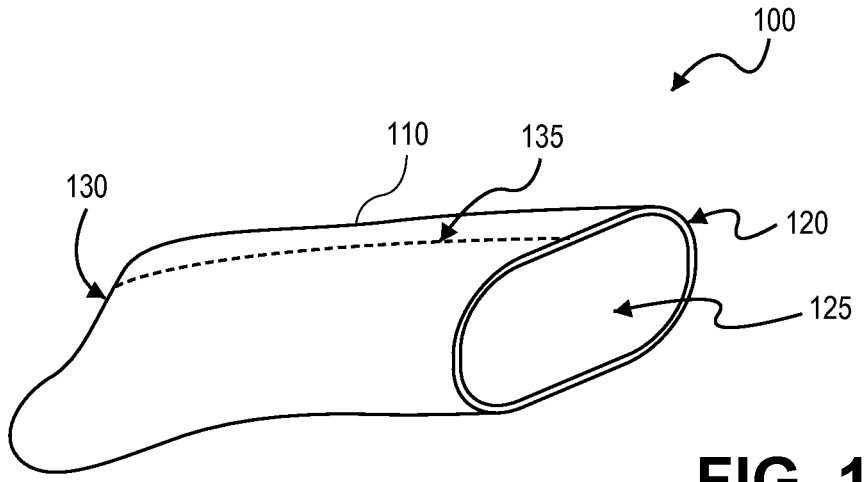
FIG. 1 shows a side perspective view of an embodiment a shield apparatus.

A generally low cost, convenient, easily installed shield for temporarily closing and covering objects such as fixtures is disclosed. The shield is particularly useful in protecting a fixture attached or otherwise protruding from a surface of a structure that is to receive a treatment, such as but not limited to a paint, a stain, a drywall mud, a plaster, or other coating material treatment, or to protect a fixture from dust particles from entering or getting onto fixtures.

A representative shield includes a body constructed from an elastic material such as, but not limited to, latex or other polymer including synthetic rubber. In one embodiment, the body may take various shapes including the shape of a tube having one or more openings (e.g., a first opening and an opposite second opening) that can be placed over a portion of the fixture, fully or partially encompassing and conforming a portion of the material of the body (e.g., an entire portion) to the shape of the fixture at a contact portion where the fixture contacts the structure (e.g., the perimeter base of the fixture) and covering a portion of the fixture or the entire fixture while conforming to a contact portion (e.g., a perimeter edge). An elastic nature of a material of the body provides the conformance of the body to at least a contact portion of the fixture and possibly to a greater surface area, including an entire surface area, of the fixture. Such conformance acts as a shield of the area of the fixture and allows treatment of the structure to which the fixture is attached without the treatment spreading (e.g., getting on) the treatment or the fixture.

In one embodiment, a shield is in the form of a container (e.g., one opening) or sleeve (e.g., opposite openings) device which when installed on a particular fixture inhibits coating material or particles from entering into or getting onto the fixture. The shield has a minimum of one opening that can be expanded to be placed over the fixture and, once over, will contract to a shape of the fixture at least at the contact portion. The elastic material of the shield is generally impervious to the types of coating material and particle matter typically used in treating a surface of a structure including coverings that can enter into or get onto a fixture. The opening of the body exhibits an expanded or a contracted state and is biased toward the contracted state. When the body exhibits its expanded state such as by an outward extending force applied by human hands or an instrument, the opening is sufficiently large so that the opening may pass over the fixture or the fixture may be passed through the opening. After inserting the fixture into the opening or vice versa, the outward extending force is released and the opening contracts on the fixture or at least on a contact portion of the fixture and is sufficiently secure to the fixture so that a weight of the shield may be supported merely by the elastic action of the contact with the fixture.

FIG. 1 shows an embodiment of a shield apparatus. Shield 100 includes body 110 made of an elastic material, such as natural rubber latex, nitrile, polychloroprene, polyurethene, polyvinyl chloride, polyethylene, polyisoprene, or other elastic polymer material and mixtures thereof. In the embodiment, body 110 has a generally tubular shape. A shape may be dictated by shape of a fixture to be shielded with shield 100. A generally tubular shape offers versatility in that it may be placed over a variety of fixtures, particularly fixtures that protrude more than a few inches from a structure such as a door handle, doorstop, or lighting fixture. Other shapes for body 110 include, but are not limited to, conical, rectangular, and oval. Still other shapes include fixture specific shapes, i.e., shapes that resemble a perimeter of a fixture. An exterior dimension of body 110, in one embodiment, is selected to be sufficient to surround at least a contact portion of the fixture (i.e., that portion), and in another embodiment, the entire exposed portion of the fixture protruding from a structure. In one embodiment, body 110 defines a lumen that is undifferentiated. An example of a body with a differentiated lumen is a glove where the fingers of the glove are differentiated from one another.

Referring to FIG. 1, body 110 of shield apparatus 100 is defined by first end 120 and second end 130. First end 120 is open and second end 130 is closed defining a container structure. Alternatively, second end 130 may also be open defining a sleeve structure. Cavity 125 into body 110 through opening 120 is defined by a dimension of body 110.

A shield apparatus, such as shield apparatus 100 of an elastic material such as latex, may be formed by dip coating one or more layers (preferably multiple layers) over a form, such as a tubular form, heat treating to cross-link elastomeric materials in the layer and curing. One specific way to make a latex glove of natural rubber is described in U.S. Pat. No. 5,284,607. A similar technique may be used to form shield apparatus 100 with the form taking a desired shape (e.g., tubular, rectangular, oval, conical, fixture specific shape).

Shield apparatus 100 may optionally include a seam such as a perforated slit extending in a length direction along body 110. Seam 135 provides a tear point to split shield apparatus 100 (split body 110) and facilitate removal of shield apparatus from a fixture. Seam 135 may be formed using a form having projections linearly spaced along a length of the form to which layer(s) of elastic material are not adhered during the formation process. Alternatively, seam 135 may be added after body 110 is formed, for example, by perforating body 110 with an implement (e.g., pin or laser).

Figure 2:
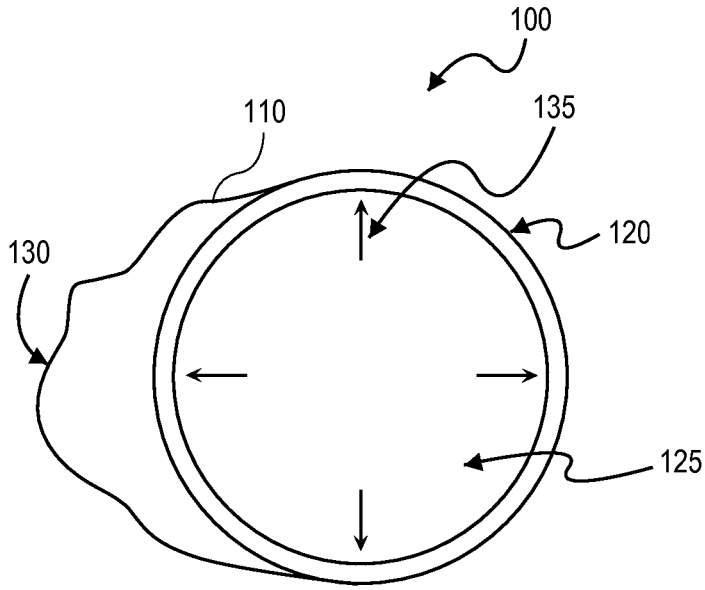
FIG. 2 shows the apparatus of FIG. 1 with an opening of the apparatus expanded.

To be placed over a fixture, opening 120 and a portion of shield apparatus 100 may be expanded. FIG. 2 shows opening 120 in an expanded state wherein an outward extending force indicated by arrows 135, is applied by human hands or an instrument. In one embodiment, opening 120 may be expanded to a dimension that is larger than a perimeter of the fixture to which shield apparatus 100 is to be placed over.

As noted above, shield apparatus 100 is made of an elastic material thus opening 120 may be expanded as shown in FIG. 2. When an outward extending force (outward extending force 135) is removed, the elastic nature of a material for shield apparatus 100 will return opening 120 and a portion of shield apparatus to a contracted state. The contracted state may be the natural state of the shield apparatus, such as shown in FIG. 1, or conform to at least the contact portion of the fixture and, in another embodiment, to the dimensions of the perimeter of the fixture. It should be noted that, although opening 120 is shown in FIG. 2 as expanded, in one embodiment, body 110 of an elastic material may be expanded to a similar dimension so that body 110 may be placed over a fixture.

Figure 3:
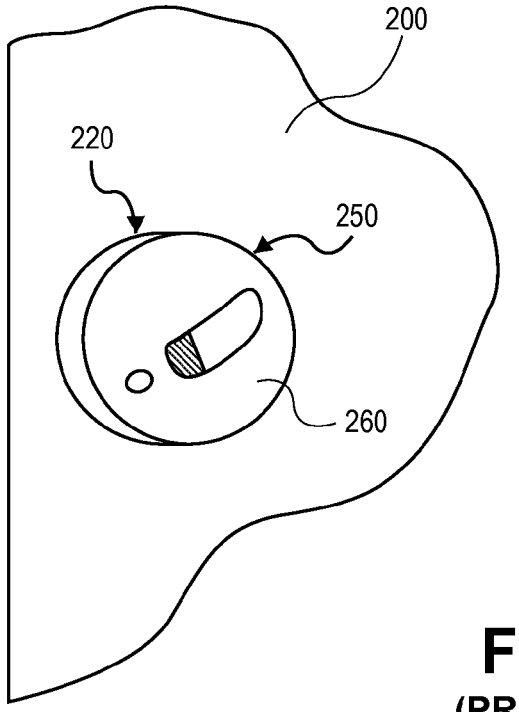
FIG. 3 (PRIOR ART)
FIG. 3 shows a top, side perspective view of a smoke detector on a wall structure.
Figure 4:
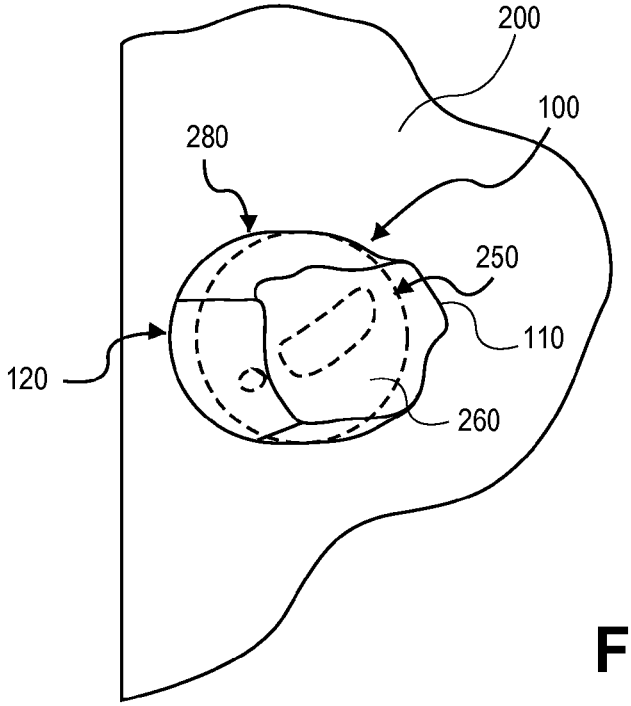
FIG. 4 shows the apparatus of FIG. 1 placed over the smoke detector of FIG. 3.
Figure 5:
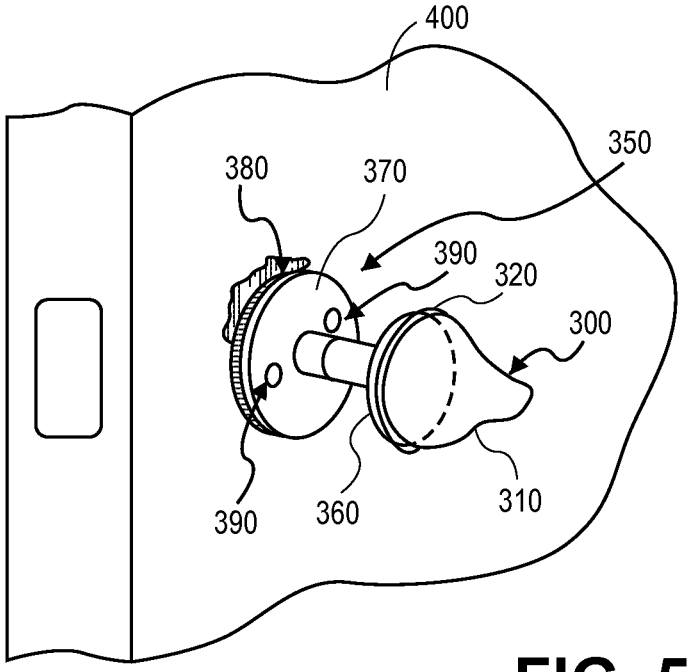
FIG. 5 shows a top, side perspective view of a door handle attached to a door structure with an embodiment of a shield apparatus placed over a portion of the knob.
Figure 6:
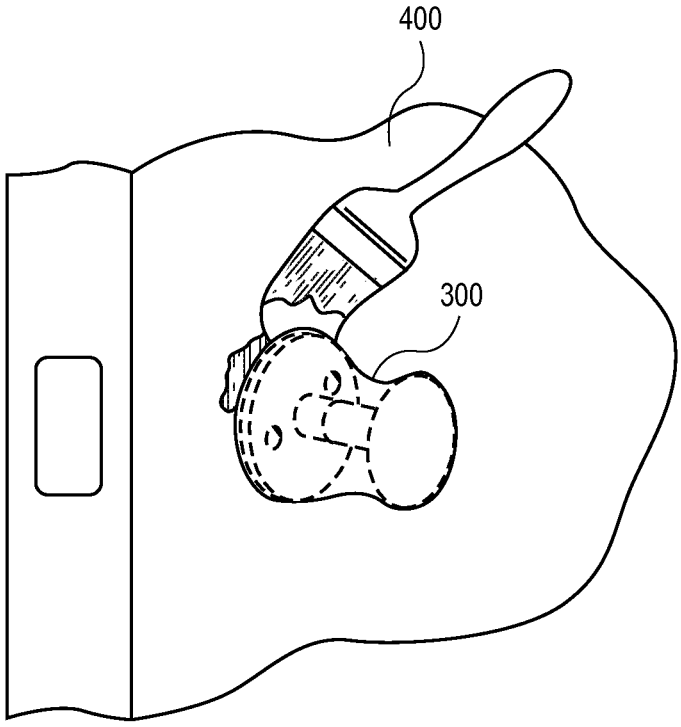
FIG. 6 shows the embodiment of FIG. 5 with the shield placed over an escutcheon of the doorknob assembly and the door structure receiving paint.

FIG. 3 shows an embodiment of a fixture on a structure. FIG. 3 shows structure 200 that is a wall or a ceiling structure. Disposed on and protruding from structure 200 is fixture 250 which, in this embodiment, is a conventional smoke detector having a tubular body 260 that protrudes from structure 200 approximately one to two inches. Smoke detector fixture 250 contacts structure 200 at contact portion 280 defining a circular perimeter. Where structure 200 is to be treated, such as sanded, painted, stained, etc., or adjacent to a structure or other element to be treated, it is often desirable to protect smoke detector fixture 250 while retaining it attached to structure 200. FIG. 4 shows shield apparatus 100 placed over smoke detector fixture 250. Specifically, opening 120 of shield apparatus 100 is expanded and shield apparatus 100 is placed (moved) over smoke detector fixture 250 to, in this embodiment, encompass the protruding portion of smoke detector fixture 250 (i.e., that portion (the entire portion) that protrudes from structure 200). Once shield apparatus 100 is placed over smoke detector fixture 250, the outward extending force applied to shield apparatus 100 through opening 120 is released and shield apparatus 100 contracts to conform to a shape of smoke detector fixture 250 at least at contact portion 280 where smoke detector fixture 250 contacts structure 200. Alternatively, shield apparatus 100 may be placed on a distally protruding edge of smoke detector fixture 250 expanding shield apparatus 100 at opening 120 to a diameter of the fixture. Shield apparatus 100 may then be maneuvered in a proximal direction (by a proximal force) over smoke detector fixture 250. Having been placed as shown in FIG. 4, shield apparatus 100 protects smoke detector fixture 250 from a subsequent treatment of structure 200, such as a subsequent sanding, painting, or staining FIGS. 5-6 show another embodiment of placing a shield apparatus over a fixture. The figures show structure 400 that is a door having door handle 350 attached thereto. Door handle 350 includes knob 360 and escutcheon plate 370. Escutcheon 370 directly contacts door structure 400, at contact portion 380. Door handle 350 is attached to door 400 through screws 390 (two screws) through escutcheon 370. In the embodiment shown in FIG. 5 and FIG. 6, screws 390 have been loosened but not removed to allow the separation of escutcheon 370 from door structure 400. In this manner, contact portion 380 may be separated from contact with door structure 400 but door handle 350 is still connected to door structure 400 and may still be operable. FIG. 5 shows an embodiment of a shield apparatus (shield apparatus 300) including body 310 of an elastic material and having opening 320 at one end defining an interior cavity of body 310. FIG. 5 shows opening 320 expanded and shield apparatus 300 partially placed over door handle 350 (partially placed over knob 360 at this point). In a contracted state, shield apparatus 300 has opening 320 and body 310 defining a smaller volume and exterior dimension than a volume and exterior dimension or perimeter of door handle 350. To place shield apparatus 300 over door handle 350, an outward extending force is applied to shield apparatus through opening 320 to put shield apparatus in an expanded state. FIG. 6 shows shield apparatus 300 placed completely over door handle 350, including over knob 360 and escutcheon 370. In one embodiment, this is achieved by maintaining an outward extending force on shield apparatus 300 so that an interior cavity of shield apparatus 300 is larger than and does not contact door handle 350 or by pulling or pushing (applying a force in the direction of structure 400) shield apparatus 300 over door handle 350 so that body 310 expands as necessary. When an outward extending or other force is released from application to opening 320 and body 310 of shield apparatus 300, an elastic nature of shield apparatus 300 will cause the opening 320 and body 310 to contract to a shape of, in this case, escutcheon 370 and knob 360 of doorknob 350. Where escutcheon 370 is separated from door structure 400, an end of shield apparatus 300 defined by opening 320 may be positioned between escutcheon 370 and door structure 400. When an outward extending or other force is released, shield apparatus will contract over escutcheon 370. FIG. 6 shows door structure 400 receiving a painting treatment. As illustrated, because escutcheon plate has been partially separated from door structure 400, a painting operation may include that portion of structure 400 that is contacted by contact portion 380 of escutcheon plate 370.

Figure 7:
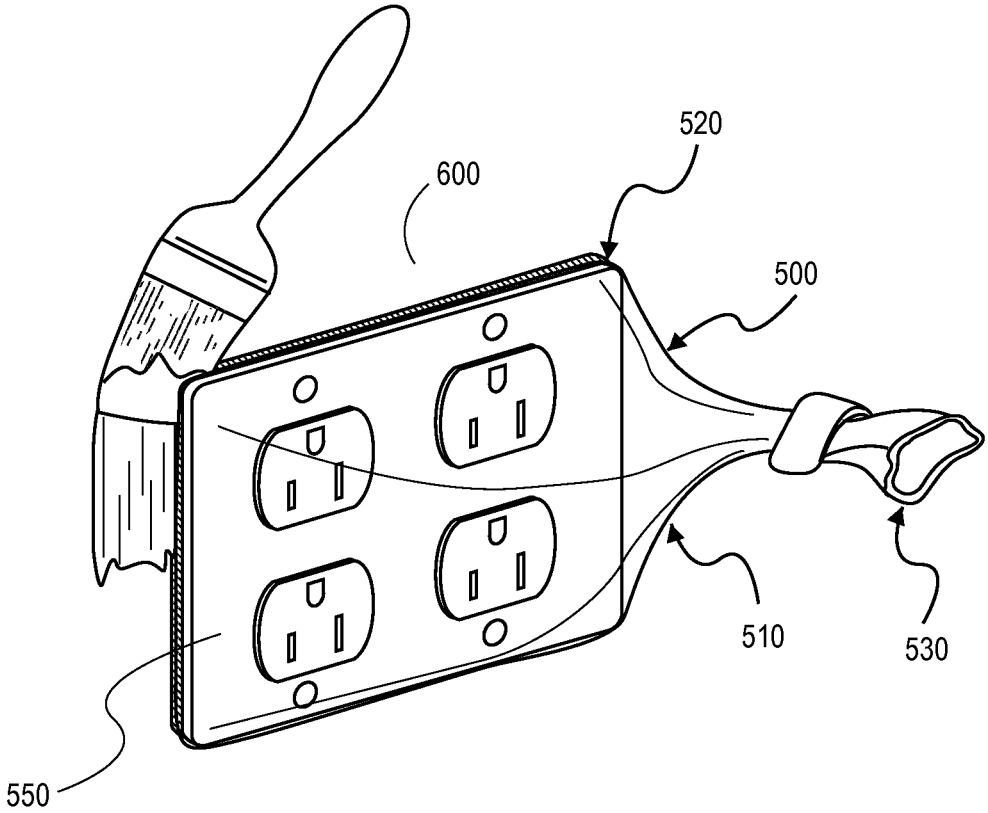
FIG. 7 shows a top, side perspective view of an electrical outlet partially detached from a wall structure and having an embodiment of a shield apparatus placed over the outlet plate.

FIG. 7 shows another embodiment of a shield apparatus. In this embodiment, shield 500 is in the form of a sleeve of body 310 with opposite openings, first opening 520 and second opening 530. Shield apparatus 500 in this embodiment is used to protect an electrical outlet (a four-prong outlet). Because electrical outlets are generally rectangular, shield apparatus may have a generally rectangular shape with length and width dimensions on the order of three inches by three inches for a 3.5-4 inch×3.5-4 inch plate. A depth dimension may vary from a few inches to several inches (e.g., 100 inches or more) to all second opening 530 to be tied off as shown. Although a rectangular shield apparatus is described, it is appreciated that other shapes will also function in this embodiment including cylindrical and conical shapes.

Referring to FIG. 7, faceplate 550 of the electrical outlet is not in direct contact with wall structure 600. Instead, one or more screws that secure faceplate 550 to the electrical outlets and to wall structure 600 are loosened but not removed. Following loosening of the one or more screws, shield apparatus 500 may be placed over faceplate 550 to cover the entire faceplate. FIG. 7 shows wall structure 600 receiving a painting treatment on an area of the structure beneath an area covered by faceplate 550.

Fixtures typically have a portion, that is mounted or attached to a surface area. As described above and illustrated in the attached figures, a shield for fixtures during a treatment of the structure is described. In one embodiment, the shield is a disposable elastic material, which is adapted to fit over, and to be held attached to all or a portion of the fixture. The shield maybe directly installed over the fixture in its current state or the fixture may be loosened from the surface area so as to create a gap for the elastic material to constrict into, thus forming a seal around and behind the exterior and interior edges or a base of the fixture. The expanded state of the opening of the shield occurs when the shield is expanded to as much as approximately the full extent permitted by the quantity of the material surrounding the opening. In the expanded state, a body portion of the shield may be placed over a fixture or the fixture may be inserted through opening into the interior of the shield. The elastic nature of the shield will then cause a contraction so that it exhibits its contracted state by withdrawing any force applied to the shield surrounding opening and allowing the shield to contract until it clamps against a base or body portion of fixture. This clamping action provides sufficient frictional force so that a weight of the shield may be supported b fixture.

Due to the flexibility provided by the shield, one size could be useful for a wide variety of different sized and shaped articles. The opening and the elasticity of the material around the opening define the size of the opening in an expanded state. The elasticity can be made to vary. The elasticity also permits easy installation and removal of the shield.

In the preceding detailed description, reference is made to specific embodiments thereof. It will, however, be evident that various modifications and changes may be made thereto without departing from the broader spirit and scope of the following claims. The specification and drawings are, accordingly, to be regarded in an illustrative rather than a restrictive sense.

What is claimed is:

1. A method comprising:

placing a body defining an undifferentiated lumen therein over a portion of a fixture coupled to a building structure, the body having at least one opening that can be expanded from a contracted state and that is biased toward the contracted state, the placing comprising applying an expansion force to the opening;

conforming the body to a shape of the fixture at a contact portion where the fixture contacts the structure by releasing the expansion force; and treating the structure.

2. The method of claim 1, wherein the body comprises a first end with an opening and a second end and prior to placing the body over the fixture, the method comprises expanding the first end to a diameter greater than an outside diameter of the contact portion of the fixture.

3. The method of claim 2, wherein placing the body comprises placing the body over the contact portion of the fixture.

4. The method of claim 2, wherein prior to placing the body over a portion of the fixture, displacing the contact portion of the fixture from contact with the structure at an area to be treated without separating the fixture from the structure.

5. The method of claim 4, wherein placing the body over a portion of the fixture comprises placing the first end of the body beyond the contact portion of the fixture such that the contact portion is within the lumen.

6. The method of claim 4, wherein the fixture comprises a doorknob and the contact portion of the fixture comprises an escutcheon plate and separating the fixture from the structure comprises separating the escutcheon plate from contact with the structure.

7. The method of claim 2, wherein placing the body over the fixture comprises placing the body over all exposed portions of the fixture.

8. The method of claim 2, wherein the second end of the body is closed.

9. The method of claim 2, wherein the second end of the body is open.

10. The method of claim 1, wherein treating comprises painting or staining the structure.

11. The method of claim 1, wherein the fixture is selected from the group consisting of a handle, an outlet, a light fixture, a smoke detector and an emblem.

12. The method of claim 1, wherein the body has a tubular shape.

13. The method of claim 1, wherein the body comprises a seam extending in a length direction.

14. A method comprising:

placing a body defining an undifferentiated lumen therein over a portion of a fixture on a building structure that is selected from a wall, door and ceiling, the body having at least one opening that can be expanded from a contracted state and that is biased toward the contracted state, the placing comprising applying an expansion force to the opening;

conforming the body to a shape of the fixture at a contact portion where the fixture contacts the structure by releasing the expansion force; and treating the structure.

15. The method of claim 14, wherein the treating is selected from a treatment involving paint, stain, drywall mud and plastering.

* * * * *